US011215047B2

(12) United States Patent
Wu et al.

(10) Patent No.: US 11,215,047 B2
(45) Date of Patent: Jan. 4, 2022

(54) ITERATIVE BOREHOLE SHAPE ESTIMATION OF CAST TOOL

(71) Applicant: Halliburton Energy Services, Inc., Houston, TX (US)

(72) Inventors: Xiang Wu, Singapore (SG); Yao Ge, Singapore (SG); Jing Jin, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 16/637,571

(22) PCT Filed: May 14, 2019

(86) PCT No.: PCT/US2019/032262

§ 371 (c)(1),
(2) Date: Feb. 7, 2020

(87) PCT Pub. No.: WO2020/231414

PCT Pub. Date: Nov. 19, 2020

(65) Prior Publication Data

US 2021/0148218 A1 May 20, 2021

(51) Int. Cl.
*E21B 47/085* (2012.01)
*E21B 47/002* (2012.01)

(52) U.S. Cl.
CPC ..... *E21B 47/085* (2020.05); *E21B 47/0025* (2020.05)

(58) Field of Classification Search
CPC .. E21B 47/0025; E21B 47/003; E21B 47/005; E21B 47/08; E21B 47/085
See application file for complete search history.

(56) References Cited

U.S. PATENT DOCUMENTS 6,891,777 B2 5/2005 Pabon et al.
7,260,477 B2 8/2007 Haughland
(Continued)

FOREIGN PATENT DOCUMENTS

WO 2008094050 8/2008

OTHER PUBLICATIONS

"Advanced borehole imaging independent of mud type," Schlumberger. Jun. 2002.

(Continued)

*Primary Examiner* — Tara Schimpf
(74) *Attorney, Agent, or Firm* — Benjamin Ford; C. Tumey Law Group PLLC

(57) ABSTRACT

A method for identifying a shape of a borehole may comprise disposing a measurement assembly into the borehole, transmitting a pressure pulse from the at least one transducer, recording the echo with the at least one transducer producing data points based at least in part on the echo to determine a distance from an inner wall of the borehole to the measurement assembly; performing a kurtosis on the data points; comparing a result of the kurtosis to a pre-determined threshold; and producing one or more repositioning results based at least in part on the comparing the result of the kurtosis to the pre-determined threshold. A system may comprise a measurement assembly which may include at least one transducer connected to the measurement assembly and an information handling system.

26 Claims, 8 Drawing Sheets

(56) References Cited

U.S. PATENT DOCUMENTS

| | | | | |
|---|---|---|---|---|
| 8,015,868 | B2 | 9/2011 | Hassan et al. | |
| 8,194,497 | B2 | 6/2012 | Michael | |
| 8,547,788 | B2 | 10/2013 | Wang et al. | |
| 9,103,196 | B2 | 8/2015 | Zhao et al. | |
| 2012/0188090 | A1* | 7/2012 | Wessling | E21B 47/002 340/853.1 |
| 2017/0082767 | A1* | 3/2017 | Jesus | G01V 1/44 |
| 2017/0115423 | A1 | 4/2017 | Hori et al. | |
| 2017/0199295 | A1 | 7/2017 | Mandal | |
| 2017/0322332 | A1* | 11/2017 | Cooper | G01V 1/306 |
| 2018/0252837 | A1* | 9/2018 | Tang | G01V 3/24 |
| 2018/0266239 | A1* | 9/2018 | Jarrot | E21B 47/002 |

OTHER PUBLICATIONS

ISRWO International Search Report and Written Opinion for PCT/US2019/032262 dated Feb. 6, 2020.

* cited by examiner

ITERATIVE BOREHOLE SHAPE ESTIMATION OF CAST TOOL

BACKGROUND

Boreholes drilled into subterranean formations may enable recovery of desirable fluids (e.g., hydrocarbons) using any number of different techniques. Currently, drilling operations may identify subterranean formations through a bottom hole assembly if the subterranean formation is disposed horizontal to the bottom hole assembly. In measurement operations, a measurement assembly may operate and/or function to determine the shape of a borehole. During measurement operations it may be important to determine a borehole shape to enable many different borehole analysis algorithms. The Circumferential Acoustic Scanning Tool (CAST) characterizes the borehole shape by azimuthally emitting acoustic pulses and measuring the travel time of the reflected signal. However, correctly identifying a "keyseat" shape in a borehole is difficult. Currently, erroneous circle fitting algorithms mischaracterize the shape and/or depth of a keyset in the wall of a borehole.

Existing methods and system presume the borehole is either circular or elliptical in shape during operations in which the center of the borehole is determined. However, the borehole is generally not circular or elliptical, more so during drilling operations. This may be due to keyseats formed in the borehole during and/or after drilling operations.

BRIEF DESCRIPTION OF THE DRAWINGS

These drawings illustrate certain aspects of some examples of the present disclosure and should not be used to limit or define the disclosure.

DETAILED DESCRIPTION

This disclosure may generally relate to a system and method of a bottom hole assembly measurement system configured to identify borehole shapes that include keyseats. A "keyseat" is defined as a small-diameter channel worn into the side of a larger diameter wellbore. Keyseats may be formed as a result of a sharp change in direction of a wellbore, of if a hard formation ledge is left between softer formation that enlarge over time. Additionally, keyseats may be formed from downhole tools and/or wirelines wearing away the outer wall of the wellbore. The system includes multiple ultrasonic transducers or transducer/receivers to measure the tool location with respect to a borehole wall. It should be noted that transducers may also be referred to as a transceiver, which may be a device that both transmit a pressure pulse and receiver a reflected echo.

As discussed below, systems and methods are proposed that may be highly robust to distorted measurement in estimating borehole shapes with keyseats. Embodiments of the systems and methods may only utilize an ultrasonic caliper measurement to identify keyseats with the borehole. As discussed below, methods and systems may identify a center of the borehole and a shape of the borehole for every cross section or within a certain depth interval by multiple measurements of the standoff, where the standoff is computed from ultrasonic caliper data.

In examples discussed below, ultrasonic caliper measurements may be analyzed to identify the commonly existing "keyseat" borehole cross section, and penalizing the tool offset in an iterative manner under a weighted circle fitting scheme. This method may provide high-accuracy and robust tool center estimation, and subsequent a reliable borehole characterization.

Figure 1:
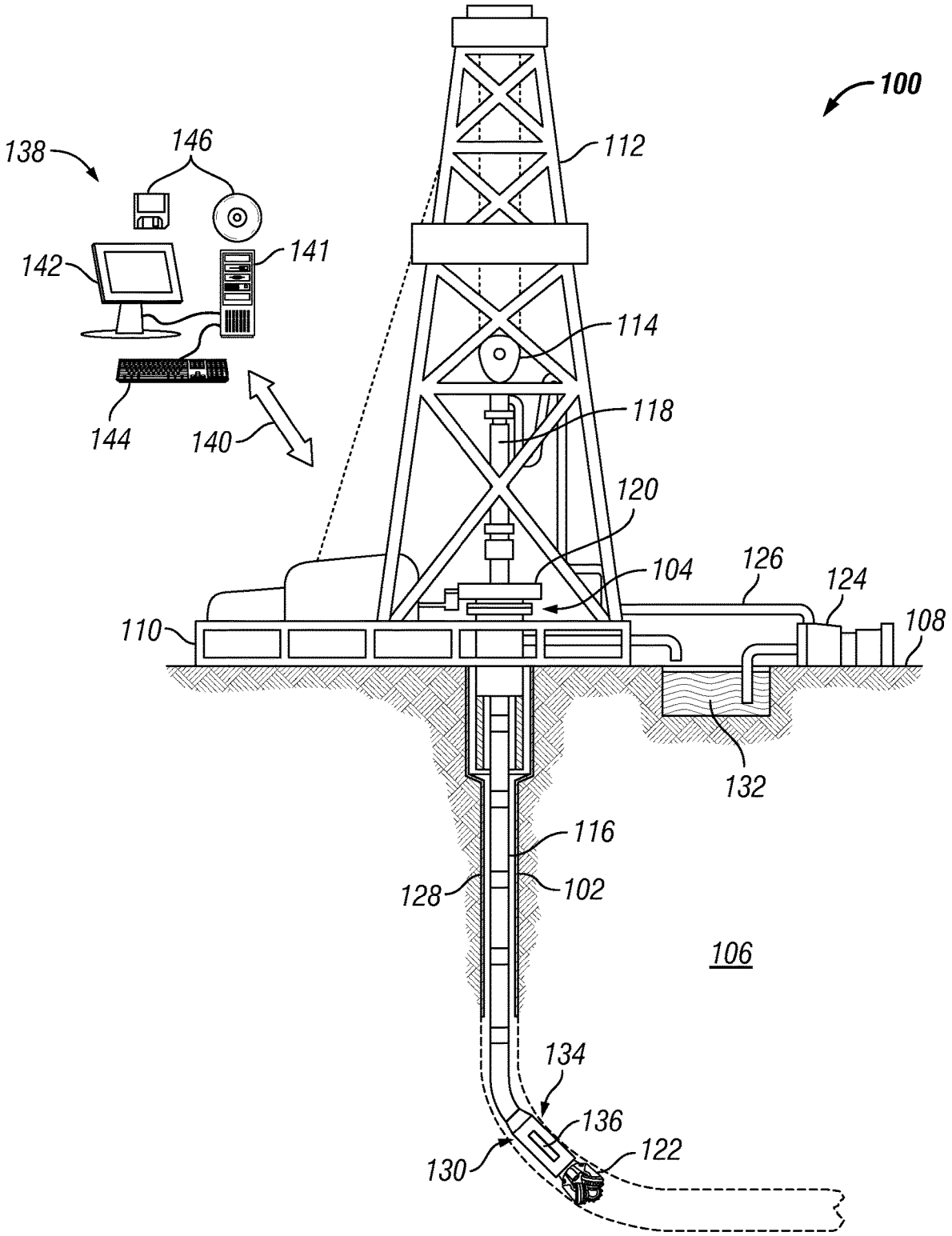
FIG. 1 illustrates an example of a drilling system.

FIG. 1 illustrates a drilling system 100 in accordance with example embodiments. As illustrated, borehole 102 may extend from a wellhead 104 into a subterranean formation 106 from a surface 108. Generally, borehole 102 may include horizontal, vertical, slanted, curved, and other types of borehole geometries and orientations. Borehole 102 may be cased or uncased. In examples, borehole 102 may include a metallic member. By way of example, the metallic member may be a casing, liner, tubing, or other elongated steel tubular disposed in borehole 102.

As illustrated, borehole 102 may extend through subterranean formation 106. As illustrated in FIG. 1, borehole 102 may extend generally vertically into the subterranean formation 106, however borehole 102 may extend at an angle through subterranean formation 106, such as horizontal and slanted boreholes. For example, although FIG. 1 illustrates a vertical or low inclination angle well, high inclination angle or horizontal placement of the well and equipment may be possible. It should further be noted that while FIG. 1 generally depict land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor and/or via rotation of drill string 116 from surface 108. Without limitation, drill bit 122 may include, roller cone bits, PDC bits, natural diamond bits, any hole openers, reamers, coring bits, and the like. As drill bit 122 rotates, it may create and extend borehole 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse borehole 102. Drill bit 122 may be attached to a distal end of drill string 116 and may be driven, for example, either by a downhole motor and/or via rotation of drill string 116 from surface 108. Drill bit 122 may be a part of bottom hole assembly (BHA) 130 at distal end of drill string 116. BHA 130 may further include tools for look-ahead resistivity applications. As will be appreciated by those of ordinary skill in the art, BHA 130 may be a measurement-while drilling (MWD) or logging-while-drilling (LWD) system.

It should be noted that during drilling operations borehole 102 is assumed to be either a circle or an ellipse during operations in which the center of borehole 102 is identified. However, this may not be true in many examples, more so during drilling operations. This may be due to the inclusion of keyseats within borehole 102. Keyseats may move BHA 130 away from the center of borehole 102. Methods discussed below may take into account that BHA 130 may not be centered in borehole 102 to correct measurements related to the shape of borehole 102 and keyseats.

BHA 130 may comprise any number of tools, transmitters, and/or receivers to perform downhole measurement operations. For example, as illustrated in FIG. 1, BHA 130 may include a measurement assembly 134. It should be noted that measurement assembly 134 may make up at least a part of BHA 130. Without limitation, any number of different measurement assemblies, communication assemblies, battery assemblies, and/or the like may form BHA 130 with measurement assembly 134. Additionally, measurement assembly 134 may form BHA 130 itself. In examples, measurement assembly 134 may comprise at least one transducer 136, which may be disposed at the surface of measurement assembly 134. Without limitation, transducer 136 may also be disposed within measurement assembly 134. Without limitation, there may be four transducers 136 that may be disposed ninety degrees from each other. However, it should be noted that there may be any number of transducers 136 disposed along BHA 130 at any degree from each other. Transducers 136 may function and operate to generate an acoustic pressure pulse that travels through borehole fluids. In examples, transducers 136 may further sense and acquire the reflected pressure wave which is modulated (i.e., reflected as an echo) by the borehole wall. During measurement operations, the travel time of the pulse wave from transmission to recording of the echo may be recorded. This information may lead to determining a radius of the borehole, which may be derived by the fluid sound speed. By analyzing the amplitude of the echo signal, the acoustic impedance may also be derived. Without limitation, transducers 136 may be made of piezo-ceramic crystals, or optionally magnetostrictive materials or other materials that generate an acoustic pulse when activated electrically or otherwise. In examples, transducers 136 may also include backing materials and matching layers. It should be noted that transducers 136 and assemblies housing transducers 136 may be removable and replaceable, for example, in the event of damage or failure.

Without limitation, BHA 130 may be connected to and/or controlled by information handling system 138, which may be disposed on surface 108. Without limitation, information handling system 138 may be disposed downhole in BHA 130. Processing of information recorded may occur downhole and/or on surface 108. Processing occurring downhole may be transmitted to surface 108 to be recorded, observed, and/or further analyzed. Additionally, information recorded on information handling system 138 that may be disposed downhole may be stored until BHA 130 may be brought to surface 108. In examples, information handling system 138 may communicate with BHA 130 through a communication line (not illustrated) disposed in (or on) drill string 116. In examples, wireless communication may be used to transmit information back and forth between information handling system 138 and BHA 130. Information handling system 138 may transmit information to BHA 130 and may receive as well as process information recorded by BHA 130. In examples, a downhole information handling system (not illustrated) may include, without limitation, a microprocessor or other suitable circuitry, for estimating, receiving and processing signals from BHA 130. Downhole information handling system (not illustrated) may further include additional components, such as memory, input/output devices, interfaces, and the like. In examples, while not illustrated, BHA 130 may include one or more additional components, such as analog-to-digital converter, filter and amplifier, among others, that may be used to process the measurements of BHA 130 before they may be transmitted to surface 108. Alternatively, raw measurements from BHA 130 may be transmitted to surface 108.

Any suitable technique may be used for transmitting signals from BHA 130 to surface 108, including, but not limited to, wired pipe telemetry, mud-pulse telemetry, acoustic telemetry, and electromagnetic telemetry. While not illustrated, BHA 130 may include a telemetry subassembly that may transmit telemetry data to surface 108. At surface 108, pressure transducers (not shown) may convert the pressure signal into electrical signals for a digitizer (not illustrated). The digitizer may supply a digital form of the telemetry signals to information handling system 138 via a communication link 140, which may be a wired or wireless link. The telemetry data may be analyzed and processed by information handling system 138.

As illustrated, communication link 140 (which may be wired or wireless, for example) may be provided that may transmit data from BHA 130 to an information handling system 138 at surface 108. Information handling system 138 may include a personal computer 141, a video display 142, a keyboard 144 (i.e., other input devices.), and/or non-transitory computer-readable media 146 (e.g., optical disks, magnetic disks) that can store code representative of the methods described herein. In addition to, or in place of processing at surface 108, processing may occur downhole.

As discussed below, methods may be utilized by information handling system 138 to determine a shape of borehole 102 and the location and shape of keyseats that may be included in borehole 102. Information may be utilized to produce an image, which may be generated into a two or three-dimensional model of borehole 102 and a keyseat. These models may be used for identifying the location of a keyseat and how the keyseat may affect downhole drilling and/or logging operations.

Figure 2:
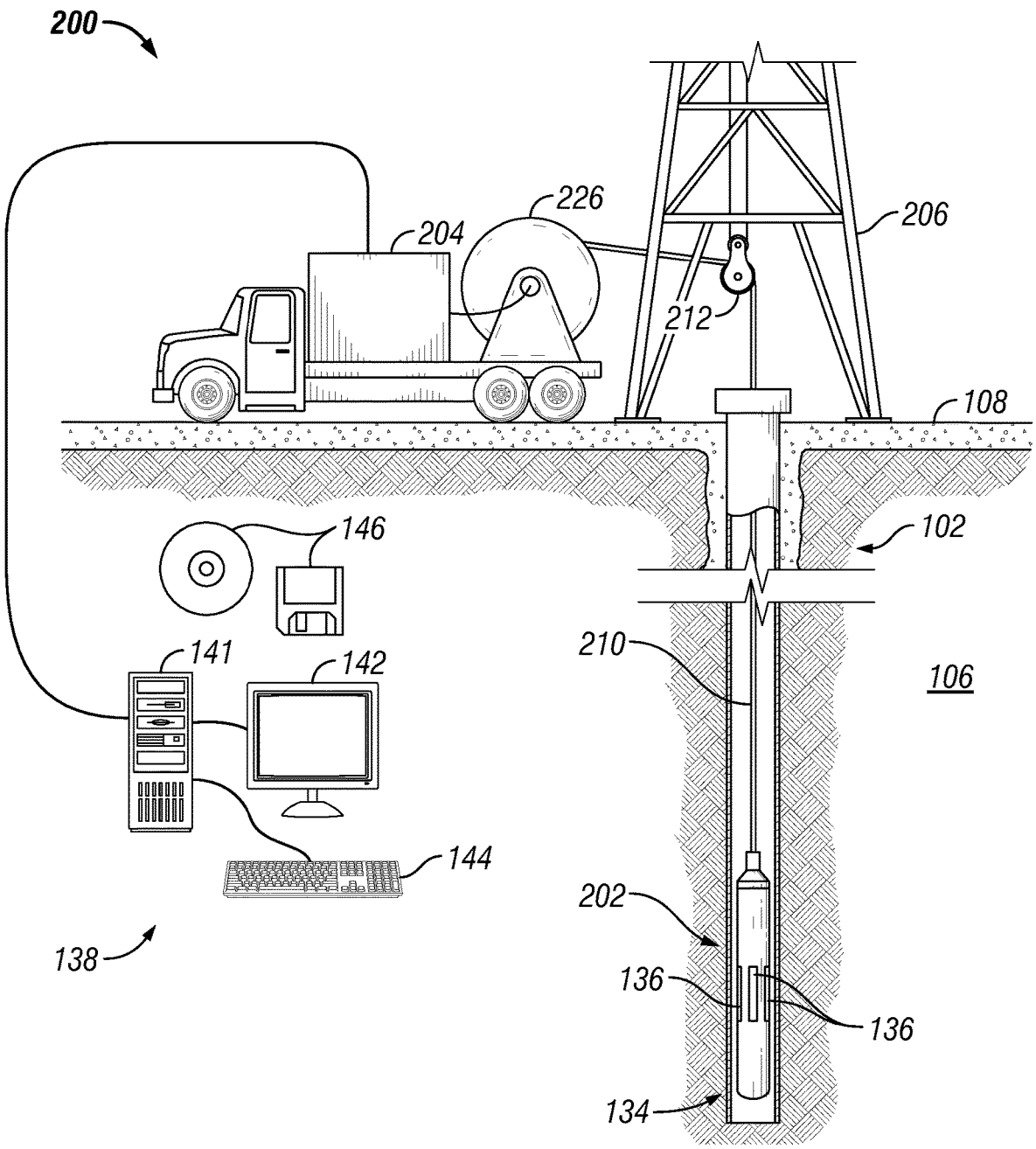
FIG. 2 illustrates an example of a well measurement system.

FIG. 2 illustrates a cross-sectional view of a well measurement system 200 in accordance with example embodiments. As illustrated, well measurement system 200 may comprise downhole tool 202 attached a vehicle 204. In examples, it should be noted that downhole tool 202 may not be attached to a vehicle 204. Downhole tool 202 may be supported by rig 206 at surface 108. Downhole tool 202 may be tethered to vehicle 204 through conveyance 210. Conveyance 210 may be disposed around one or more sheave wheels 212 to vehicle 204. Conveyance 210 may include any suitable means for providing mechanical conveyance for downhole tool 202, including, but not limited to, wireline, slickline, coiled tubing, pipe, drill pipe, downhole tractor, or the like. In some embodiments, conveyance 210 may provide mechanical suspension, as well as electrical and/or optical connectivity, for downhole tool 202. Conveyance 210 may comprise, in some instances, a plurality of electrical conductors and/or a plurality of optical conductors extending from vehicle 204, which may provide power and telemetry. In examples, an optical conductor may utilize a battery and/or a photo conductor to harvest optical power transmitted from surface 108. Conveyance 210 may comprise an inner core of seven electrical conductors covered by an insulating wrap. An inner and outer steel armor sheath may be wrapped in a helix in opposite directions around the conductors. The electrical and/or optical conductors may be used for communicating power and telemetry between vehicle 204 and downhole tool 202. Information from downhole tool 202 may be gathered and/or processed by information handling system 138. For example, signals recorded by downhole tool 202 may be stored on memory and then processed by downhole tool 202. The processing may be performed real-time during data acquisition or after recovery of downhole tool 202. Processing may alternatively occur downhole or may occur both downhole and at surface. In some embodiments, signals recorded by downhole tool 202 may be conducted to information handling system 138 by way of conveyance 210. Information handling system 138 may process the signals, and the information contained therein may be displayed for an operator to observe and stored for future processing and reference. Information handling system 138 may also contain an apparatus for supplying control signals and power to downhole tool 202.

Systems and methods of the present disclosure may be implemented, at least in part, with information handling system 138. While shown at surface 108, information handling system 138 may also be located at another location, such as remote from borehole 102. Information handling system 138 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 138 may be a personal computer 141, a network storage device, or any other suitable device and may vary in size, shape, performance, functionality, and price. Information handling system 138 may include random access memory (RAM), one or more processing resources such as a central processing unit (CPU) or hardware or software control logic, ROM, and/or other types of nonvolatile memory. Additional components of the information handling system 138 may include one or more disk drives, one or more network ports for communication with external devices as well as various input and output (I/O) devices, such as a keyboard 144, a mouse, and a video display 142. Information handling system 138 may also include one or more buses operable to transmit communications between the various hardware components. Furthermore, video display 142 may provide an image to a user based on activities performed by personal computer 141. For example, producing images of geological structures created from recorded signals. By way of example, video display unit may produce a plot of depth versus the two cross-axial components of the gravitational field and versus the axial component in borehole coordinates. The same plot may be produced in coordinates fixed to the Earth, such as coordinates directed to the North, East and directly downhole (Vertical) from the point of entry to the borehole. A plot of overall (average) density versus depth in borehole or vertical coordinates may also be provided. A plot of density versus distance and direction from the borehole versus vertical depth may be provided. It should be understood that many other types of plots are possible when the actual position of the measurement point in North, East and Vertical coordinates is taken into account. Additionally, hard copies of the plots may be produced in paper logs for further use.

Alternatively, systems and methods of the present disclosure may be implemented, at least in part, with non-transitory computer-readable media 146. Non-transitory computer-readable media 146 may include any instrumentality or aggregation of instrumentalities that may retain data and/or instructions for a period of time. Non-transitory computer-readable media 146 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

In examples, rig 206 includes a load cell (not shown) which may determine the amount of pull on conveyance 210 at the surface of borehole 102. Information handling system 138 may comprise a safety valve (not illustrated) which controls the hydraulic pressure that drives drum 226 on vehicle 204 which may reel up and/or release conveyance 210 which may move downhole tool 202 up and/or down borehole 102. The safety valve may be adjusted to a pressure such that drum 226 may only impart a small amount of tension to conveyance 210 over and above the tension necessary to retrieve conveyance 210 and/or downhole tool 202 from borehole 102. The safety valve is typically set a few hundred pounds above the amount of desired safe pull on conveyance 210 such that once that limit is exceeded, further pull on conveyance 210 may be prevented.

As illustrated in FIG. 2, downhole tool 202 may include measurement assembly 134. It should be noted that measurement assembly 134 may make up at least a part of downhole tool 202. Without limitation, any number of different measurement assemblies, communication assemblies, battery assemblies, and/or the like may form downhole tool 202 with measurement assembly 134. Additionally, measurement assembly 134 may form downhole tool 202 itself. In examples, measurement assembly 134 may comprise at least one transducer 136, which may be disposed at the surface of measurement assembly 134. Without limitation, transducer 136 may also be disposed within measurement assembly 134. Without limitation, there may be four transducers 136 that may be disposed ninety degrees from each other. However, it should be noted that there may be any number of transducers 136 disposed along BHA 130 at any degree from each other. Transducers 136 may function and operate to generate and receive acoustic pulses in the borehole fluid.

It should be noted that during logging operations borehole 102 is assumed to be either a circle or an ellipse during operations in which the center of borehole 102 is identified. However, this may not be true in many examples. As discussed above, This may be due to the inclusion of keyseats within borehole 102. Keyseats may move downhole tool 202 away from the center of borehole 102. Methods discussed below may take into account that downhole tool 202 may not be centered in borehole 102 to correct measurements related to the shape of borehole 102 and keyseats.

As discussed below, methods may be utilized by information handling system 138 to determine a shape of borehole 102 and the location and shape of keyseats that may be included in borehole 102. Information may be utilized to produce an image, which may be generated into a two or three-dimensional model of borehole 102 and a keyseat. These models may be used for identifying the location of a keyseat and how the keyseat may affect downhole drilling and/or logging operations.

Figure 3:
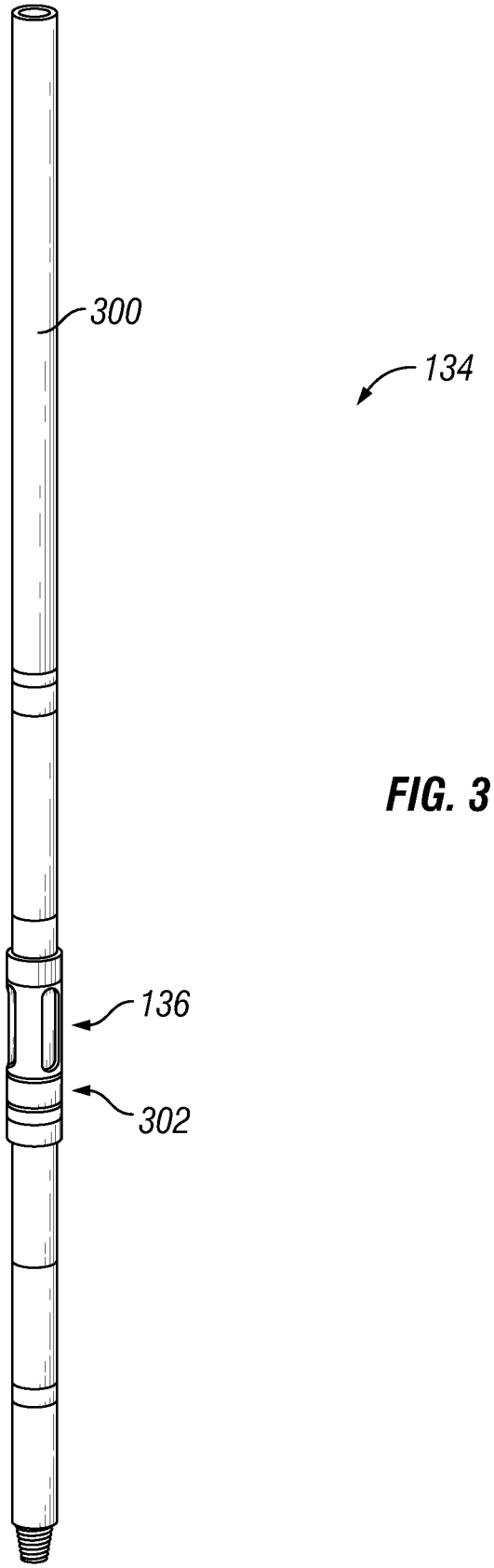
FIG. 3 illustrates an example of a measurement assembly.

FIG. 3 illustrates a close-up view of measurement assembly 134, in accordance with example embodiments. As illustrated, measurement assembly 134 may comprise at least one battery section 300 and at least on instrument section 302. Battery section 300 may operate and function to enclose and/or protect at least one battery that may be disposed in battery section 300. Without limitation, battery section 300 may also operate and function to power measurement assembly 134. Specifically, battery section 300 may power at least one transducer 136, which may be disposed at any end of battery section 300 in instrument section 302.

Instrument section 302 may house at least one transducer 136. As describe above, transducer 136 may operate and function and operate to generate an acoustic pressure pulse that travels through borehole fluids. During operations, transducer 136 may emit a pressure wave, specifically an ultrasonic pressure pulse wave. The pressure pulse may have any suitable frequency range, for example, from about 200 kHz to about 400 kHz, with center around 250 KHz, in some embodiments. It should be noted that the pulse signal may be emitted with different frequency content. As discussed above, transducers 136 may be referred to as a caliper, sensors, a "pinger," and/or transducer, which may allow transducers 136 to measure and/or record echoes. Echoes may be the reflection of the pressure pulse off the wall of a borehole. Recordings and/or measurements taken by transducer 136 may be transmitted to information handling system 138 by any suitable means, as discussed above.

Recorded echoes may identify the location and/or shape of a keyseat in borehole 102 (e.g., referring to FIG. 1) during drilling operations or logging operations (e.g., referring to FIG. 2). It should be noted that the shape of a keyseat within borehole 102 may be generally the same for each keyseat throughout borehole 102. Current methods take this generality into account when performing circle fitting methods to identify the shape of borehole 102. However, in examples where a long standoff may be found from a reflected echo, the regularization of iteratively penalizing the misfit using methods to determine a keyseat shape may produce a keyseat shape that may be inaccurate, as the keyseat may have a long standoff.

As discussed above, current methods presume the borehole is either a circle or an ellipse during operation sin which the center of the borehole is identified. However, this may not be true in many examples, more so during drilling operations (e.g., referring to FIG. 1). As "keyseat" shapes may be identified frequently in cross sections of a borehole during drilling operations. Methods described below may take into account that one or more keyseats may be identified within the wall of a borehole and may not create a biased circle fitting result. Methods disclosed below may be adaptive to a high firing rate of transducers 136 (e.g., referring to FIG. 1). Thus, methods and systems may provide accurate borehole cross sections over any depth in a borehole. Additionally, methods and system may estimate a more accurate equivalent borehole radius over depth, estimate a more accurate borehole volume, characterize the properties within the borehole, and monitor the evolution of the borehole wall. For example, the method may produce a weighted iterative nonlinear circle fitting, penalize a tool offset during circle fitting, and/or accommodate the condition of tool motion and rotation.

Measurement of the borehole shape has significant importance in drilling and following downhole operation. Understand the formation mechanical properties (e.g., keyseat, breakouts) may allow personnel to adjust drilling parameters (e.g., mud weight), and control the integrity and stability of borehole 102 (e.g., referring to FIG. 1). In examples, computing the volume of borehole 102 may allow personnel to pump an accurate amount of cement when casing the borehole.

Current system may measure one or more standoffs from the wall of borehole 102 (e.g., referring to FIG. 1) to the surface of measurement assembly 134 (e.g., referring to FIG. 1). The first method may use mechanical calipers, which may be spring-loaded and may physically touch the wall of borehole 102 due to the spring force. From the displacement of the moving components, the shape of borehole 102 may be measured. This method may be limited to wireline tools that don't rotate (e.g., referring to FIG. 2). In addition, the range of the measurement may be restricted by the maximal extension of the moving components.

The second method is non-contact using ultrasonic calipers. In examples, ultrasonic calipers (i.e., transducers 136) may transmit ultrasonic waves which may reflect off the wall of borehole 102. The reflected ultrasonic waves may be received and/or recorded by measurement assembly 134. Identifying the speed of the ultrasonic waves may allow an operator to determine the travel distance of the ultrasonic waves. The travel distance may be used to determine the shape of borehole 102. This method does not require physical contact to borehole 102 and may be used for a measurement assembly 134 that may rotate in measurement/logging-while-drilling (M/LWD) tool string during drilling operations (e.g., referring to FIG. 1). Thus, the method may not be practical to characterize the shape of borehole 102 based on a direct measurement. Hence, non-contact ultrasonic methods may be suitable for drilling operations. After identifying standoffs, the shape of borehole 102 may be estimated by an N-point curve fitting of the apparent diameters (summation of diagonal standoffs plus diameter of measurement assembly 134) to a circle or an ellipse with a least squares (LS) method. As disclosed above, borehole 102 may not be circular or elliptical. As discussed below, the shape of borehole 102 may be characterized on statistics of apparent diameters of the wall of borehole 102 and measurement assembly 134 instead of a LS fitting on it.

Figure 4:
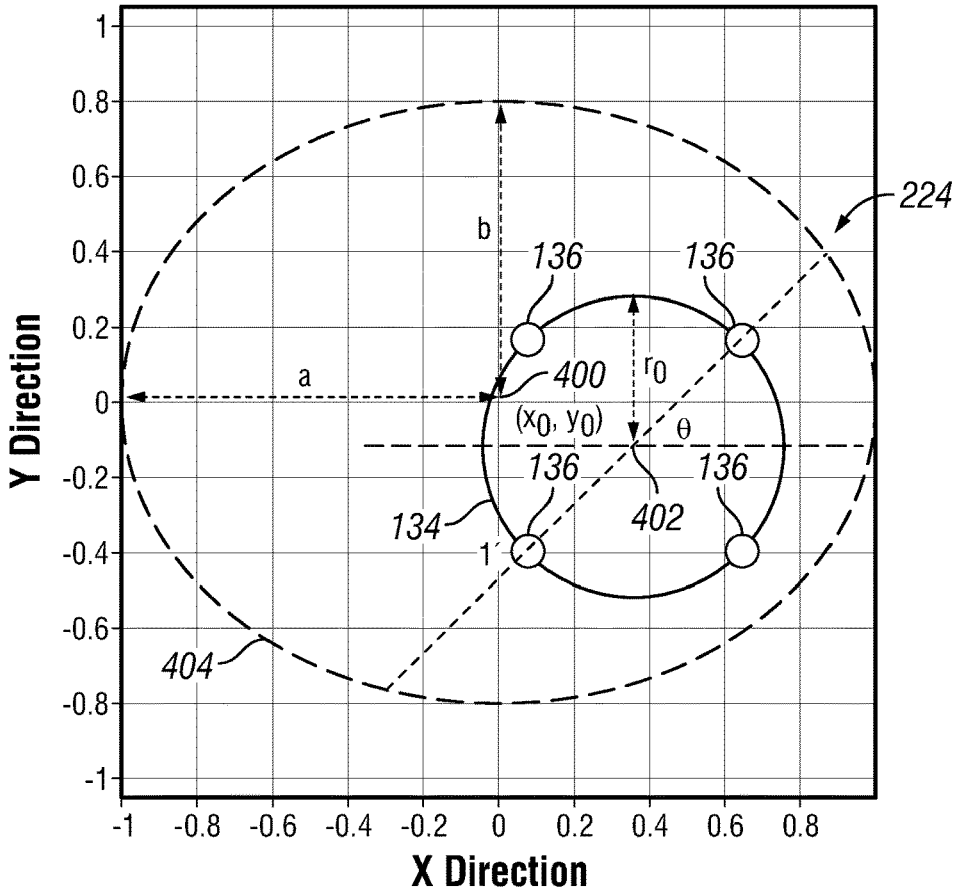
FIG. 4 is a graph illustrating the position of the measurement assembly in a borehole.

FIG. 4 illustrates a top down view of borehole 102, in accordance with example embodiments. As illustrated, measurement assembly 134, which may be connected to drill bit 122 (e.g., referring to FIG. 1), may be disposed within borehole 102. It should be noted that measurement assembly 134 may be spinning with drill bit 122 while it is eccentric from the centroid of the presumed borehole ellipse. Center 400 of borehole 102 is set at the origin of the Cartesian coordinate system, and the intersection borehole is presumed to be an ellipse with major axis a and minor axis b. The intersection of measurement assembly 134 is circular with radius $r_0$ and center 402 of measurement assembly 134 is at $(x_0, y_0)$. During drilling operations, trip-in and trip-out operation, drill bit 122 and measurement assembly 134 may be free from inner wall 404 of borehole 102 so that ($x_0$, $y_0$) may be arbitrary but constrained within the bounds of inner wall 404.

Transducers 136 may be disposed on measurement assembly 134 as discussed above in FIG. 3. It should be noted that the location of transducers 136 may also be the location of calipers (which may be used interchangeably) which may also send out ultrasonic signals and collect the echoes from inner wall 404 of borehole 102. As illustrated, there may be four transducers 136, however there may be any number of transducers 136 disposed on measurement assembly 134. It should be noted that in examples in which calipers may be used, there are a minimal number of calipers employed which may be evenly spaced around the surface of measurement assembly 134. In examples, a minimal number of calipers may be two or more calipers.

During measurement operations, a standoff may be computed from the two-way travel time $t_{twoway}$ of the first arriving echoes/reflections, which could be written as:

$$\text{standoff} = V_{borehole} \cdot \frac{c_{twoway}}{2} \tag{1}$$

where $V_{borehole}$ is sound velocity of the media in borehole 102, of which the content is mostly mud during drilling operations. In examples, the estimated standoff and travel time from the casing section (if there is) may be used to calculate $V_{borehole}$, since the geometry of the casing sections is known. Alternatively, the mud velocity may also be obtained precisely in situ if a mud cell (not illustrated) is installed on BHA 130 with measurement assembly 134 (e.g., referring to FIG. 1). In examples, a mud cell may operate like an ultrasonic caliper but send and receive ultrasonic waves from a fixed target instead of the wall of borehole 102. From the flight-of-time for a fixed distance, the mud velocity may be obtained accurately, yet the mud velocity might vary with depth in borehole 102. In operations the apparent radius of inner wall 404 may be defined as $r_i$ for transducer #i, which may be conceptualized mathematically as:

$$r_i = \text{standoff}_i + r_0 \tag{2}$$

For a four-caliper system, i ranges from 1 to 4. Therefore, there may be five unknowns $x_0$, $y_0$, a, b, and s (s is set unknown because the actual inclination angle of the elliptical borehole may not be known) if borehole 102 is assumed to be an ellipse. However, for a single firing system, the may only be 4 standoff measurement to identify a radius of inner wall 404. Thus, the system may be underdetermined. Conventional methods may forcibly set the shape of borehole 102 to be a circle by considering that fact that the eccentricity of the ellipse may be small. The number of unknowns is then reduced to 3, (i.e., $x_0$, $y_0$, R) where R is the fitted radius of the borehole. The circle fitting yields:

$$x_i^2 + y_i^2 + a(1) \cdot x_i + a(2) \cdot y_i + a(3) = 0 \tag{3}$$

where $$\begin{cases} x_i = r_i \cos\theta_i \\ y_i = r_i \sin\theta_i \end{cases} \tag{4}$$

and the azimuth angle $\theta_i$ for transducer #i referenced to the high site of the borehole may be obtained by a gyrometer (not illustrated) attached to BHA 130. Additional, a (·) are the fitting parameters associated with the circle parameters $x_0$, $y_0$, R:

$$\begin{cases} x_0 = -\frac{1}{2}a(1) \\ y_0 = -\frac{1}{2}a(2) \\ R = \sqrt{\frac{a(1)^2 + a(2)^2}{4} - a(3)} \end{cases} \tag{5}$$

However, the circle fitting equation may be re-written to a matrix as:

$$\begin{pmatrix} x_1 & y_1 & 1 \\ \dots & \dots & \dots \\ x_4 & y_4 & 1 \end{pmatrix} \begin{pmatrix} a(1) \\ a(2) \\ a(3) \end{pmatrix} = -\begin{pmatrix} x_1^2 + y_1^2 \\ \dots \\ x_4^2 + y_4^2 \end{pmatrix} \tag{6}$$

Using compact notation may produce:

$$CA = B \tag{7}$$

where $$C = \begin{pmatrix} x_1 & y_1 & 1 \\ \dots & \dots & \dots \\ x_4 & y_4 & 1 \end{pmatrix} \tag{8}$$

$$A = \begin{pmatrix} a(1) \\ a(2) \\ a(3) \end{pmatrix} \tag{9}$$

$$B = -\begin{pmatrix} x_1^2 + y_1^2 \\ \dots \\ x_4^2 + y_4^2 \end{pmatrix} \tag{10}$$

Figure 5:
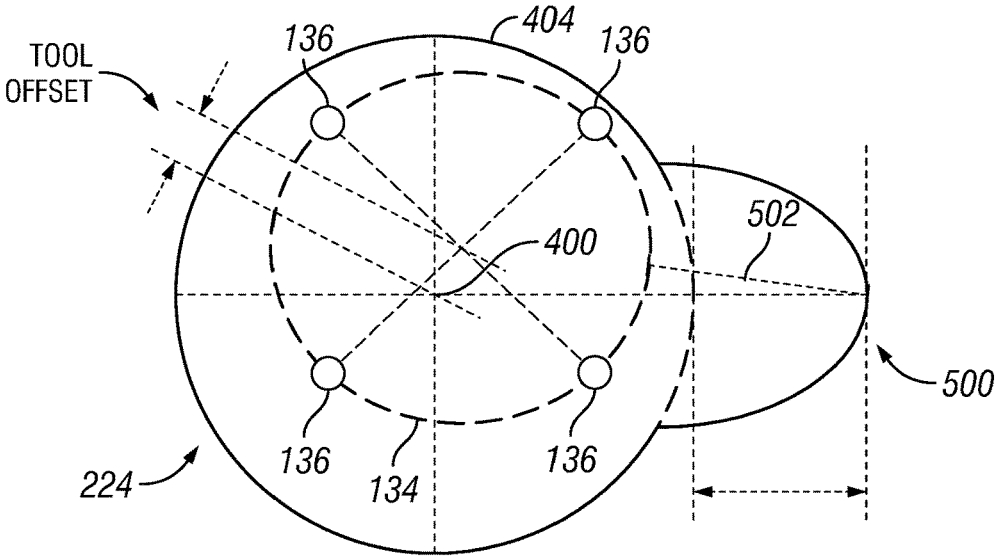
FIG. 5 illustrates a keyseat disposed in an inner wall of the borehole.

FIG. 5 illustrates a cross sectional profile of inner wall 404 of borehole 102, in accordance with example embodiments. Further illustrated is center 400 of borehole 102, keyseat 500, and cross section view of measurement assembly 134 and transducers 136. The shape of keyseat 500 in FIG. 5, as illustrated, may include a standoff 502 to the key seat area that may be longer than the radius of borehole 102. Therefore, penalizing the long standoff may diminish the discrepancy in the circle fitting.

The example methods, referred to as weighted circle fitting with tool-eccentric penalization (WCFTeP), may be performed to penalize the long standoff, which may diminish the discrepancy in circle fitting. Without limitation, WCFTeP methods may be applied on-site or post-processing manners. To begin the weighting matrix W may be defined as:

$$W_{ij} = \begin{cases} W_i & \text{if } i = j \\ 0 & \text{otherwise} \end{cases} \tag{11}$$

where $w_i$ is defined as the inverse square of the misfit between the apparent radius of borehole 223 and that of the fitted circle, shown as:

$$W_i = \frac{1}{e_i^2} = \frac{1}{(r_i - \hat{r}_i)^2} \tag{12}$$

Then the weighting matrix W is applied on Eq. (6) to get:

$$WCA=B \tag{13}$$

The direct solution, under the least squares framework, may be written as:

$$A=(C^TW^TWC)^{-1}\cdot C^TW^TB \tag{14}$$

It should be noted that W depends on the misfit, as illustrated in Eq. (12), Eq. (13) may be only solved in an iterative way. Therefore, Eq. (14) may be re-written as:

$$A^n=(C^TW_{n-1}{}^TW_{n-1}C)^{-1}\cdot C^TW_{n-1}{}^TB \tag{14}$$

where the entries $W_{i,n-1}$ for weighting matrix $W_{n-1}$ is written as:

$$W_{i,n-1} = \frac{1}{e_{i,n-1}^2} = \frac{1}{(r_i - \hat{r}_{i,n-1})^2} \tag{15}$$

Thus, A may then be solved by converging $A^n$ with certain iterations of Eq. (14). The initial values for $r_{\hat{i},0}$ guess may be obtained in various ways. For example, $r_{\hat{i},0}$ may be obtained from prior information, e.g. neighboring firings to get $x'_0$, $y'_0$, R'; $r_{\hat{i},0}$ may be obtained from fully data-driven approaches, e.g., a first attempt of standard circle fitting, or $x'_0=0$, $y'_0=0$, R'=median($r_i$).

Figure 6:
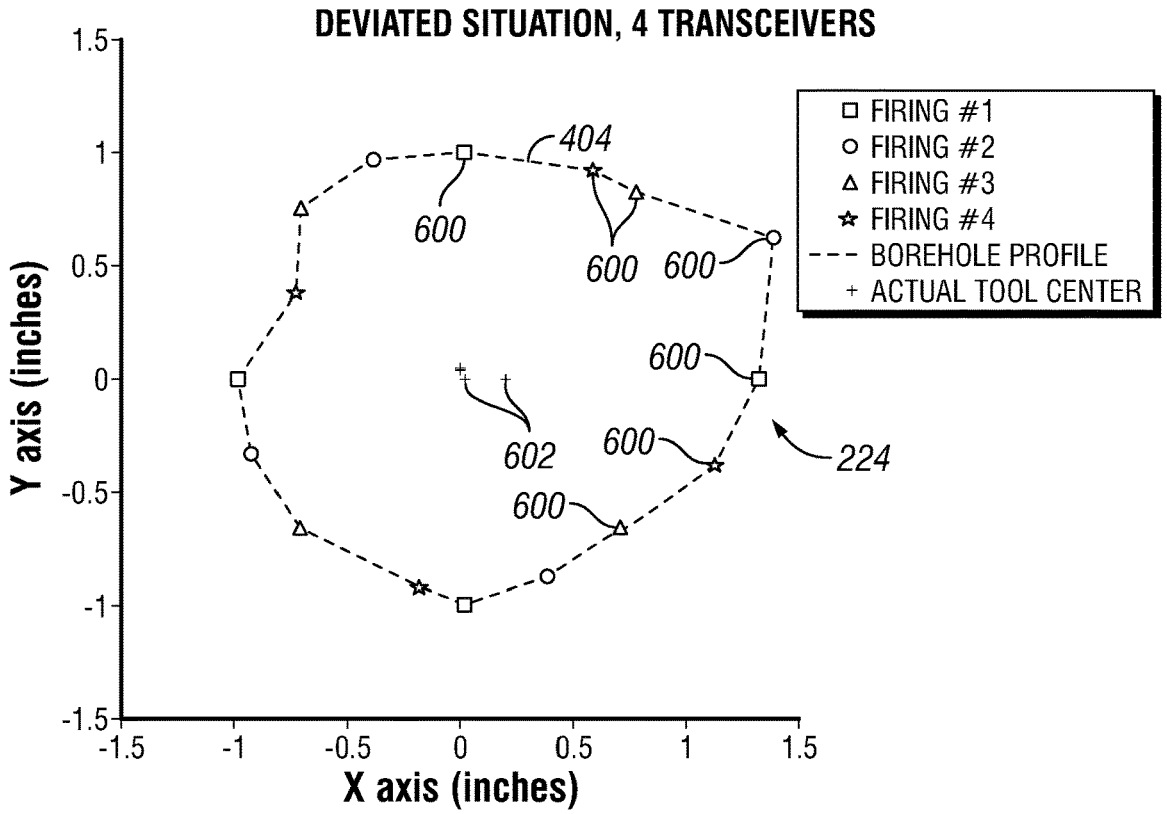
FIG. 6 is a graph illustrating measurements taken by the measurement assembly.

FIG. 6 illustrates inner wall 404 of borehole 102 as measured by measurement assembly 134 (e.g., referring to FIG. 5) which may include four transducers 136 (e.g., referring to FIG. 5) which may be about 90 degrees apart, in accordance with example embodiments. As discussed above, transducers 136 may emit an acoustic pressure pulse which may reflect off inner wall 404 at reflection points 600 at different points in time. Without limitation, measurement assembly 134 may change its location, and thus center 602 of measurement assembly 134, for every firing. The contour connected by standoff will result in a very irregular shape of inner wall 404 of borehole 102. By iteratively evaluating Eq. (14) center 602 of measurement assembly 134 may be identified for each firing. Centers 602 of measurement assembly 134 for each firing are then repositioned so that the borehole centers (for each firing) are stacked on top of each other.

Figure 7:
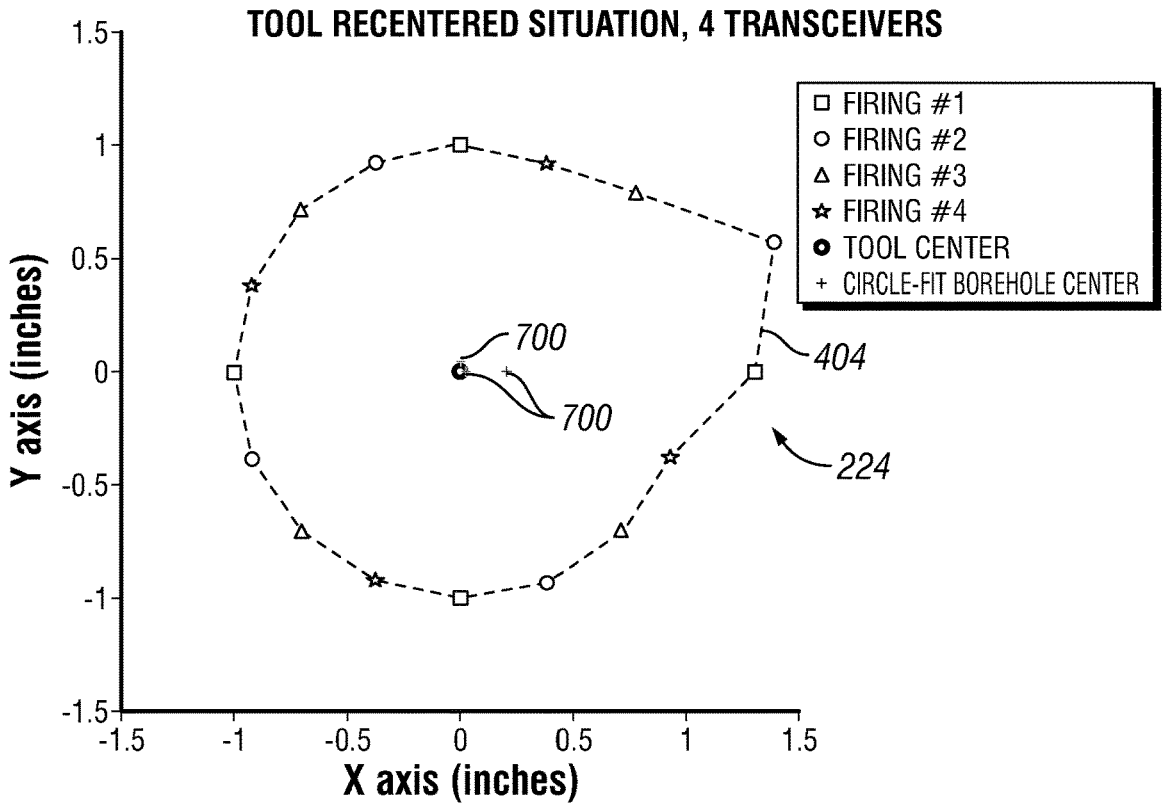
FIG. 7 is a graph illustrating the shape of the inner wall of the borehole after a center of the measurement assembly has been re-centered.
Figure 8:
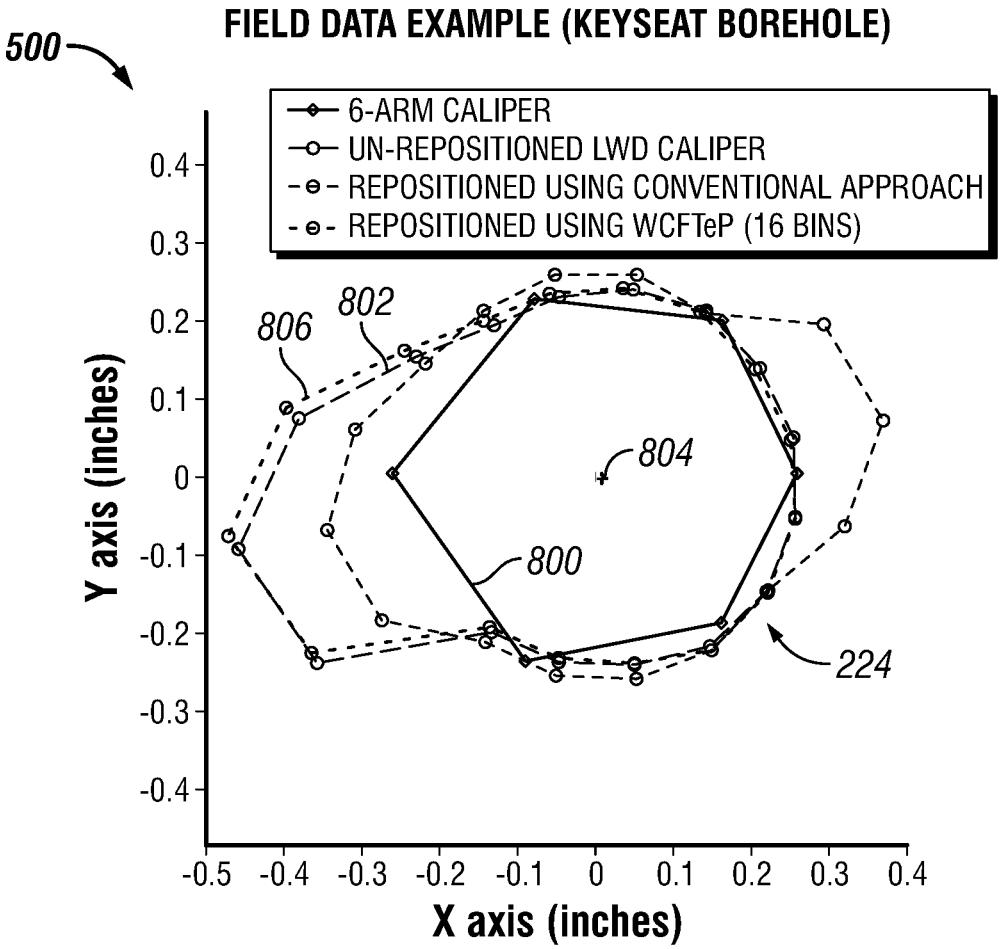
FIG. 8 is a graph illustrating different measurements of the inner wall of the borehole with different measurement methods.

FIG. 7 illustrates inner wall 404 of borehole 102 after centering of measurement assembly 134, in accordance with example embodiments. As illustrated, crossings 700 are the fitted tool locations using the method WCFTeP described above. Moreover, with a high firing rate it may be graphed to show that crossings 700 of measurement assembly 134 may move slightly so that the data may be collectively fit from multiple firings. Thus, Eq. (13) may be extended in the following:

$$\text{blockdiag}(W^1, \ldots, W^k)\begin{pmatrix} C^1 \\ \ldots \\ C^k \end{pmatrix} A = \begin{pmatrix} B^1 \\ \ldots \\ B^k \end{pmatrix} \tag{16}$$

Where the notation blockdiag(·) is to block-diagonalize all the entries in the bracket. Utilizing Equation 16, FIG. 8 illustrates a re-synthesized field example data assuming the data were collected from four transducers 136 (e.g., referring to FIG. 1) with a high firing rate and borehole 102 includes a keyseat 500 (e.g., referring to FIG. 5). As illustrated, results 800 for a 6-arm wireline caliper are overlaid for reference purpose. Additionally, pre-processed results 802 before repositioning/borehole re-centering, measurement assembly 134 (e.g., referring to FIG. 1) may be eccentric. As graphed, the area of keyseat 500 may be elongated, which may prevent caliper arms from correctly identifying the depth from center 804 of measurement assembly 134. Conventional results 806 may form an ellipse-like borehole which is misleading as to the actual shape of borehole 102. WCFTeP results 806 may identify average center 804 while not distorting the shape of borehole 102, which is an improvement over conventional fitting approaches as conventional fitting approaches do not correctly identify center 804 or keyseat 500.

It should be noted that WCFTeP method may operate incorrectly if less than half of transducers 136 disposed on measurement assembly 134 (e.g., referring got FIG. 1) are facing a keyseat 500 (e.g., referring to FIG. 5). Without limitation, less or equal to ¼ may be ideal. The offset of measuring assembly 134 may be less than ½ of the depth of keyseat 500, which may be likely due to the relative size of measurement assembly 134 and borehole 102. Otherwise, the example workflow, discussed below, may be automatically direct it to a conventional approach.

Alternatively, the formulation described from Equation (3) to (16) can be replaced by a least squared ellipse fitting.

$$x_i^2+a(1)y_i^2+a(2)x_iy_i+a(3)\cdot x_i+a(4)\cdot y_i+a(5)=0 \tag{17}$$

Figure 9:
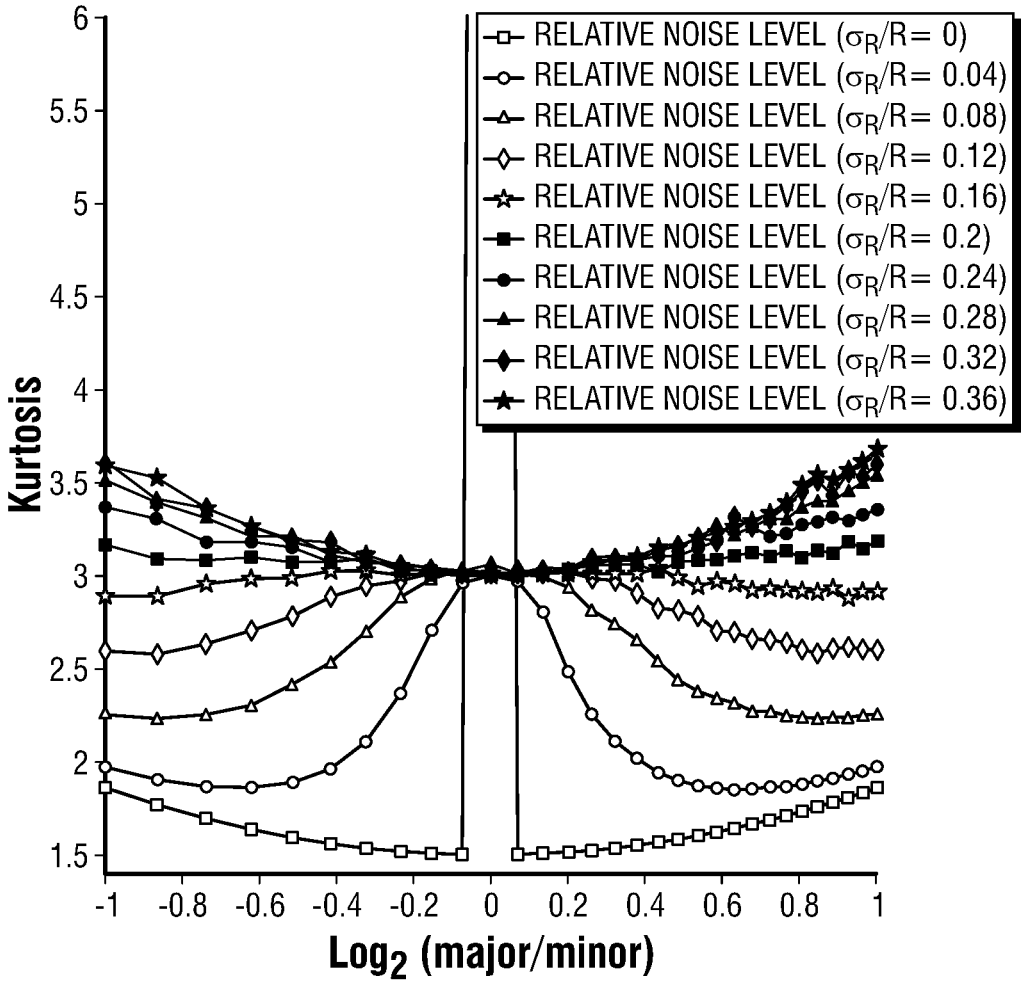
FIG. 9 is a graph of a kurtosis of a circle or an ellipse.
Figure 10:
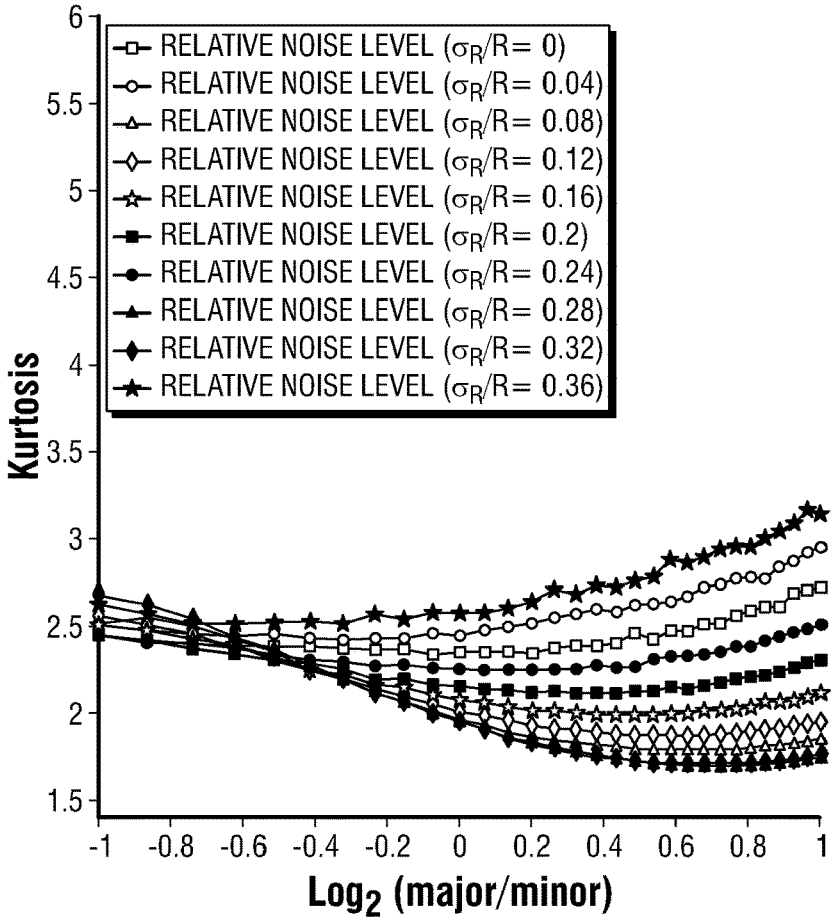
FIG. 10 is another graph of the kurtosis of a circle or an ellipse.

To overcome these limitations, a statistical quantity may be utilized. For example, without limitation the method kurtosis may be utilized. Kurtosis is defined as the ratio of the fourth moment divided by the square of the second moment. For a circle or an elliptical borehole, the kurtosis (with uncertain tool location) is shown in FIG. 9. If the mean of the location of measurement assembly 134 (e.g., referring to FIG. 1) is non-zero, the corresponding results are shown in FIG. 10. From both FIGS. 9 and 10, for a "non-peaky" circle/ellipse borehole 102, the kurtosis values are lower than 3.6 even for every a major/minor axis ratio, fluctuation of the apparent radius, and eccentricity of measurement assembly 134. Non-peaky is defined as the circle/ellipse does not have a "keyseat" or "breakout" shape. Rather, the standoff measurements form a noisy circle or ellipse shape. Without limitation, if there are prior information on the borehole characteristics, e.g., ellipticity range, the kurtosis values may be more accurately estimated.

Therefore, a tolerant criterion may be mathematically defined as:

$$\text{Kurtosis}(r_i)>T_0 \tag{18}$$

Where in examples, $T_0$ is set to 3.8 in a conservative manner. For multi-firing processing or post-processing, the workflow in FIG. 11 may be utilized.

Figure 11:
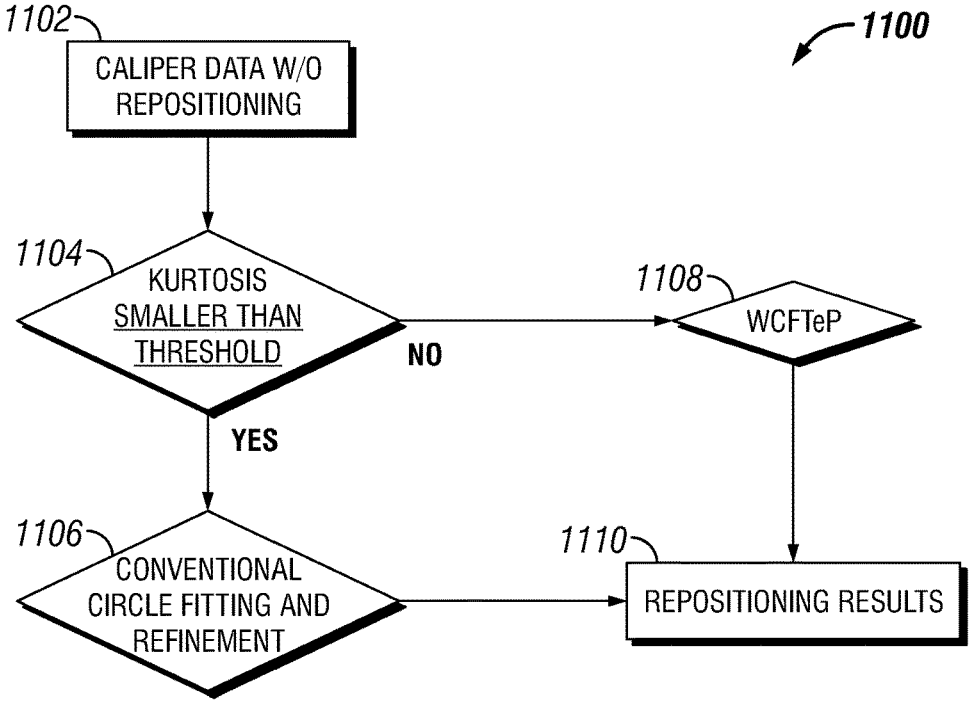
FIG. 11 is a workflow to determine a method for identifying the measurements of the inner wall of the borehole.

FIG. 11 illustrates an example workflow 1100 for determining when WCFTeP methods, described above, may be applied and when the conventional approach is more suitable. In block 1102, measurements of borehole 102 (e.g., referring to FIG. 8) may be taken. It should be noted that measurements are taken without repositioning the center of borehole 102. In block 1104, the mathematical application of Kurtosis is performed as described above. If the Kurtosis is smaller than a pre-determined threshold, than a convention fitting for refinement may be used in block 1106. In examples, the pre-determined threshold is 3.8, which is based at least in part on simulations from FIGS. 9 and 10. It should be noted that the pre-determined threshold may be lowered if there may be a constraint or estimation of a major or minor ratio. However, the pre-determined threshold must be larger than 3. Conventional fittings may be identified as the least-square circle fitting described in Equation (3) to (5). The conventional fitting may also be referred to as the least squared based elliptical fitting. If the Kurtosis is larger than the pre-determined threshold, the WCFTeP method described above may be used in block 1108. In block 1110 the results form blocks 1108 or 1106 may be presented.

As discussed above the WCFTeP method may include improvements that illustrate a borehole cross section over depth more accurate than current methods, estimate a more accurate equivalent borehole radius over depth, estimate a more accurate borehole volume, estimate a more accurate borehole center for borehole characterization, and monitor the evolution of the borehole wall.

It should be understood that, although individual examples may be discussed herein, the present disclosure covers all combinations of the disclosed examples, including, without limitation, the different component combinations, method step combinations, and properties of the system.

Statement 1. A method for identifying a shape of a borehole may comprise disposing a measurement assembly into the borehole, wherein the measurement assembly comprises at least one transducer; transmitting a pressure pulse from the at least one transducer, wherein the pressure pulse is reflected as an echo; recording the echo with the at least one transducer; producing data points based at least in part on the echo to determine a distance from an inner wall of the borehole to the measurement assembly; performing a kurtosis on the data points; comparing a result of the kurtosis to a pre-determined threshold; and producing one or more repositioning results based at least in part on the comparing the result of the kurtosis to the pre-determined threshold.

Statement 2. The method of statement 1, wherein the pre-determined threshold is 3.8.

Statement 3. The method of statements 1 or 2, further comprising performing a weighted circle fitting with tool-eccentric penalization if the kurtosis is larger than the pre-determined threshold.

Statement 4. The method of statement 3, further comprising identifying an offset of the measurement assembly.

Statement 5. The method of statement 3, further comprising identifying a shape of a keyseat included in an inner wall of the borehole.

Statement 6. The method of statement 3, further comprising re-centering a center of the measurement assembly.

Statement 7. The method of statements 1-3, further comprising performing a conventional fitting if the kurtosis is smaller than the pre-determined threshold.

Statement 8. The method of statement 7, wherein the conventional fitting is a least-square circle fitting or a least square ellipse fitting.

Statement 9. The method of statements 1-3 or 7, wherein the measurement assembly further includes one or more calipers.

Statement 10. The method of statement 9, further comprising measuring an inner wall of the borehole with the one or more calipers.

Statement 11. A system for identifying a shape of a borehole may comprise measurement assembly comprising: at least one transducer connected to the measurement assembly, wherein the at least one transducer is configured to transmit a pressure pulse and record a reflected pressure pulse as an echo; and an information handling system configured to: produce one or more data points based at least in part on the echo to determine a distance from an inner wall of a borehole to the measurement assembly; compare a result of the kurtosis to a pre-determined threshold; and produce one or more repositioning results based at least in part on the compare the result of the kurtosis to the pre-determined threshold.

Statement 12. The system of statement 11, wherein the pre-determined threshold is 3.8.

Statement 13. The system of statements 11 or 12, wherein the information handling system is further configured to perform a weighted circle fitting with tool-eccentric penalization if the kurtosis is larger than the pre-determined threshold.

Statement 14. The system of statement 13, wherein the information handling system is further configured to identify an offset of the measurement assembly.

Statement 15. The system of statement 13, wherein the information handling system is further configured to identify a shape of a keyseat included in an inner wall of the borehole.

Statement 16. The system of statement 13, wherein the information handling system is further configured to re-center a center of the measurement assembly.

Statement 17. The system of statements 11-13, wherein the information handling system is further configured to perform a conventional fitting if the kurtosis is smaller than the pre-determined threshold.

Statement 18. The system of statement 17, wherein the conventional fitting is a least-square circle fitting or a least square ellipse fitting.

Statement 19. The system of statements 11-13 or 16, wherein the measurement assembly further includes one or more calipers.

Statement 20. The system of statement 19, further comprising measuring an inner wall of a borehole with the one or more calipers.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for identifying a shape of a borehole comprising:

disposing a measurement assembly into the borehole, wherein the measurement assembly comprises at least one transducer;

transmitting a pressure pulse from the at least one transducer, wherein the pressure pulse is reflected as an echo;

recording the echo with the at least one transducer;

producing data points based at least in part on the echo to determine a distance from an inner wall of the borehole to the measurement assembly;

performing a kurtosis on the data points;

comparing a result of the kurtosis to a pre-determined threshold; and producing one or more repositioning results based at least in part on the comparing the result of the kurtosis to the pre-determined threshold.

2. The method of claim 1, wherein the pre-determined threshold is 3.8.

3. The method of claim 1, further comprising performing a weighted circle fitting with tool-eccentric penalization if the kurtosis is larger than the pre-determined threshold.

4. The method of claim 3, further comprising identifying an offset of the measurement assembly.

5. The method of claim 3, further comprising identifying a shape of a keyseat included in an inner wall of the borehole.

6. The method of claim 3, further comprising re-centering a center of the measurement assembly.

7. The method of claim 1, further comprising performing a conventional fitting if the kurtosis is smaller than the pre-determined threshold.

8. The method of claim 7, wherein the conventional fitting is a least-square circle fitting or a least square ellipse fitting.

9. The method of claim 1, wherein the measurement assembly further includes one or more calipers.

10. The method of claim 9, further comprising measuring the inner wall of the borehole with the one or more calipers.

11. A system for identifying a shape of a borehole comprising:

a measurement assembly comprising:

at least one transducer connected to the measurement assembly, wherein the at least one transducer is configured to transmit a pressure pulse and record a reflected pressure pulse as an echo; and an information handling system configured to:

produce one or more data points based at least in part on the echo to determine a distance from an inner wall of the borehole to the measurement assembly;

compare a result of a kurtosis to a pre-determined threshold;

produce one or more repositioning results based at least in part on the compared result of the kurtosis to the pre-determined threshold.

12. The system of claim 11, wherein the pre-determined threshold is 3.8.

13. The system of claim 11, wherein the information handling system is further configured to perform a weighted circle fitting with tool-eccentric penalization if the kurtosis is larger than the pre-determined threshold.

14. The system of claim 13, wherein the information handling system is further configured to identify an offset of the measurement assembly.

15. The system of claim 13, wherein the information handling system is further configured to identify a shape of a keyseat included in the inner wall of the borehole.

16. The system of claim 13, wherein the information handling system is further configured to re-center a center of the measurement assembly.

17. The system of claim 11, wherein the information handling system is further configured to perform a conventional fitting if the kurtosis is smaller than the pre-determined threshold.

18. The system of claim 17, wherein the conventional fitting is a least-square circle fitting or a least square ellipse fitting.

19. The system of claim 11, wherein the measurement assembly further includes one or more calipers.

20. The system of claim 19, wherein the information handling system is further configured to measure the inner wall of the borehole with the one or more calipers.

21. A method for identifying a shape of a borehole comprising:

disposing a measurement assembly into the borehole, wherein the measurement assembly comprises at least one transducer;

transmitting a pressure pulse from the at least one transducer, wherein the pressure pulse is reflected as an echo;

recording the echo with the at least one transducer;

producing data points based at least in part on the echo to determine a distance from an inner wall of the borehole to the measurement assembly;

performing a kurtosis on the data points;

comparing a result of the kurtosis to a pre-determined threshold;

producing one or more repositioning results based at least in part on the comparing the result of the kurtosis to the pre-determined threshold; and performing a weighted circle fitting with tool-eccentric penalization if the kurtosis is larger than the pre-determined threshold.

22. A method for identifying a shape of a borehole comprising:

disposing a measurement assembly into the borehole, wherein the measurement assembly comprises at least one transducer;

transmitting a pressure pulse from the at least one transducer, wherein the pressure pulse is reflected as an echo;

recording the echo with the at least one transducer;

producing data points based at least in part on the echo to determine a distance from an inner wall of the borehole to the measurement assembly;

performing a kurtosis on the data points;

comparing a result of the kurtosis to a pre-determined threshold;

producing one or more repositioning results based at least in part on the comparing the result of the kurtosis to the pre-determined threshold;

performing a weighted circle fitting with tool-eccentric penalization if the kurtosis is larger than the pre-determined threshold; and identifying an offset of the measurement assembly.

23. A method for identifying a shape of a borehole comprising:

disposing a measurement assembly into the borehole, wherein the measurement assembly comprises at least one transducer;

transmitting a pressure pulse from the at least one transducer, wherein the pressure pulse is reflected as an echo;

recording the echo with the at least one transducer;

producing data points based at least in part on the echo to determine a distance from an inner wall of the borehole to the measurement assembly;

performing a kurtosis on the data points;

comparing a result of the kurtosis to a pre-determined threshold;

producing one or more repositioning results based at least in part on the comparing the result of the kurtosis to the pre-determined threshold, and;

performing a conventional fitting if the kurtosis is smaller than the pre-determined threshold.

24. A system for identifying a shape of a borehole comprising:

a measurement assembly comprising:

at least one transducer connected to the measurement assembly, wherein the at least one transducer is configured to transmit a pressure pulse and record a reflected pressure pulse as an echo; and an information handling system configured to:

produce one or more data points based at least in part on the echo to determine a distance from an inner wall of the borehole to the measurement assembly;

compare a result of a kurtosis to a pre-determined threshold; and produce one or more repositioning results based at least in part on the compared result of the kurtosis to the pre-determined threshold, wherein the information handling system is further configured to perform a weighted circle fitting with tool-eccentric penalization if the kurtosis is larger than the pre-determined threshold.

25. A system for identifying a shape of a borehole comprising:

a measurement assembly comprising:

at least one transducer connected to the measurement assembly, wherein the at least one transducer is configured to transmit a pressure pulse and record a reflected pressure pulse as an echo; and an information handling system configured to:

produce one or more data points based at least in part on the echo to determine a distance from an inner wall of the borehole to the measurement assembly;

compare a result of a kurtosis to a pre-determined threshold; and produce one or more repositioning results based at least in part on the compared result of the kurtosis to the pre-determined threshold, wherein the information handling system is further configured to perform a conventional fitting if the kurtosis is smaller than the pre-determined threshold.

26. A system for identifying a shape of a borehole comprising:

a measurement assembly comprising:

at least one transducer connected to the measurement assembly, wherein the at least one transducer is configured to transmit a pressure pulse and record a reflected pressure pulse as an echo; and an information handling system configured to:

produce one or more data points based at least in part on the echo to determine a distance from an inner wall of the borehole to the measurement assembly;

compare a result of a kurtosis to a pre-determined threshold; and produce one or more repositioning results based at least in part on the compared result of the kurtosis to the pre-determined threshold, wherein the information handling system is further configured to perform a conventional fitting if the kurtosis is smaller than the pre-determined threshold, and wherein the conventional fitting is a least-square circle fitting or a least square ellipse fitting.

* * * * *